US007921970B2

(12) United States Patent
Murakami et al.

(10) Patent No.: US 7,921,970 B2
(45) **Date of Patent: *Apr. 12, 2011**

(54) SEALING DEVICE FOR ELEVATOR

(75) Inventors: Shin Murakami, Hachioji (JP); Toru Kinoshita, Kunitachi (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 82 days.

This patent is subject to a terminal disclaimer.

(21) Appl. No.: 12/408,263

(22) Filed: Mar. 20, 2009

(65) Prior Publication Data

US 2009/0178341 A1 Jul. 16, 2009

Related U.S. Application Data

(63) Continuation of application No. 11/203,090, filed on Aug. 15, 2005, now Pat. No. 7,584,825, which is a continuation of application No. PCT/JP2004/010372, filed on Jul. 14, 2004.

(30) Foreign Application Priority Data

Jul. 28, 2003 (JP) ..... 2003-202455

(51) Int. Cl.
*B66B 13/28* (2006.01)

(52) U.S. Cl. ..... 187/400; 187/313; 187/333

(58) Field of Classification Search ..... 187/313, 187/325, 333, 400

See application file for complete search history.

(56) References Cited

U.S. PATENT DOCUMENTS

| | | | |
|---|---|---|---|
| 1,406,951 | A | 2/1922 | Fehr |
| 3,734,238 | A | 5/1973 | Secresty et al. |
| 4,058,191 | A | 11/1977 | Balbo |
| 4,320,793 | A | 3/1982 | Lindbergh |
| 4,735,293 | A | 4/1988 | Everhart et al. |
| 5,836,424 | A | 11/1998 | Allen |

(Continued)

FOREIGN PATENT DOCUMENTS

JP 05-338975 A 12/1993

(Continued)

OTHER PUBLICATIONS

U.S. Appl. No. 12/408,271, filed Mar. 20, 2009, Murakami.

(Continued)

*Primary Examiner* — Thomas J Brahan
(74) *Attorney, Agent, or Firm* — Foley & Lardner LLP

(57) ABSTRACT

A sealing device for an elevator door includes a doorway member, doors, a movable member, a push-down mechanism and a sealing mechanism. The doorway member is provided for a gate. The doors open or close along the doorway member. The movable member is set horizontally and provided to be movable in a vertical direction in the doorway member, and it is urged upwards by an urging unit. The push-down mechanism pushes down the movable member against the force of the urging unit just before the doors are closed. The sealing mechanism is kept non-contact with the doors while they are moving, and seals the gap between the doors and the doorway member as it is brought into contact with upper section of the doors when the movable member is pushed down by the push-down mechanism.

6 Claims, 12 Drawing Sheets

U.S. PATENT DOCUMENTS

| | | | | |
|---|---|---|---|---|
| 5,899,303 | A | 5/1999 | Allen | |
| 6,330,763 | B1 | 12/2001 | Kern et al. | |
| 6,615,952 | B2 * | 9/2003 | Itoh et al. | 187/249 |
| 7,584,825 | B2 * | 9/2009 | Murakami et al. | 187/333 |
| 2005/0269038 | A1 | 12/2005 | Murakami | |
| 2006/0175147 | A1 | 8/2006 | Morotome et al. | |

FOREIGN PATENT DOCUMENTS

| | | | |
|---|---|---|---|
| JP | 06-234488 | A | 8/1994 |
| JP | 07-076477 | A | 3/1995 |
| JP | 07-157254 | A | 6/1995 |
| JP | 07-247086 | A | 9/1995 |
| JP | 2003-033444 | A | 2/2003 |
| JP | 2003-034481 | A | 2/2003 |
| WO | WO 96/33125 | A1 | 10/1996 |

OTHER PUBLICATIONS

S. Murakami, U.S. PTO Notice of Allowance, U.S. Appl. No. 11/203,090, Apr. 10, 2009, 7 pages.

Shin Murakami, U.S. PTO Office Action, U.S. Appl. No. 12/408,271, dated Jul. 21, 2010, 7 pages.

* cited by examiner

SEALING DEVICE FOR ELEVATOR

CROSS-REFERENCE TO RELATED APPLICATIONS

This is a Continuation Application of U.S. Ser. No. 11/203,090, filed Aug. 15, 2005, which is a continuation of PCT Application No. PCT/JP2004/010372, filed Jul. 14, 2004, which was published under PCT Article 21(2) in English. The entire contents of both of these applications are incorporated herein by reference.

This application is based upon and claims the benefit of priority from prior Japanese Patent Application No. 2003-202455, filed Jul. 28, 2003, the entire contents of which are incorporated herein by reference.

BACKGROUND OF THE INVENTION

1. Field of the Invention

The present invention relates to a sealing device for an elevator, which seals a gap between a doorway member provided in the gate of an elevator and a door device provided adjacent to the doorway member.

2. Description of the Related Art

The gate of an elevator is provided between an elevator hall in a building and an elevator shaft. The doorway member is set in the gate. A hall door is installed adjacent to the doorway member. The hall door opens when the cage, which moves up and down in the shaft, arrives at an elevator hall, thus enabling passengers to get on or off the cage. Then, when the cage departs from the elevator hall, the door closes.

In general, the hall door of an elevator is opened or closed by rolling hanger rollers provided at an upper section of the door along a hanger rail provided at an upper portion of the doorway member. In order for the hall door to smoothly open and close, a gap is created between the hall door and a three-sided frame of the doorway member, or a doorsill.

In case of a fire occurring in the building, the smoke and toxic gas due to the fire can enter the shaft of the elevator through the gap in the hall door. As a result, the smoke may spread to some other floors through the gap of the hall door of these floors, thus exposing the residents to danger.

In order to avoid such situations, some elevators are equipped with a sealing mechanism installed for the hall door, or a smoke shutting facilities such as a shutter, door and screen installed near the hall door. However, when such smoke shutting facilities that include a shutter are provided, the production cost is naturally increased. Further, the storage space and guide mechanisms that are provided afterwards deteriorate the appearance of the elevator.

As a method of prohibiting the deterioration of the appearance, there is a widely popular technique, in which a sealing mechanism is set in the hall door such that the gap between the hall door and the doorway member is shut while the door is closed. There have been a number of techniques proposed as the sealing mechanism. According to these techniques, a rubber or some other elastic member is mounted on the circumference of the door to seal the gap by the elastic member as it is pressed between the door and doorway when the door is closed. Of the members to be sealed, provided around the door, a doorstop portion and a rear side end portion of the door can be pressed by bringing the door into contact with the seal member just before the door is closed. Therefore, in connection with these members, the gaps can be sealed with a relatively simple sealing mechanism that uses a rubber, a metal plate, etc.

On the other hand, in the upper section of the door and the doorsill portion, such seal member, if a rubber or a thin metal plate is simply mounted, entails the following problem. That is, the seal member and the door are in contact with each other at all times and they slide on against each other when opening or closing the door. Therefore, the seal member wears out or loses stiffness to deteriorate its smoke shutting performance. Further, as the slide resistance is increased, the door can no longer be opened or closed smoothly or the noise created when the door slides may be increased.

Jpn. Pat. Appln. KOKAI Publications Nos. 6-234488 and 7-76477 each disclose a mechanism for shutting the gap in the upper section of the door, in which the seal member is brought into contact with the member on the other side when the door has been closed. In this mechanism, the seal member is set inclined and mounted on the upper section of the door. This mechanism is designed to inhibit the seal member and the other member from contacting with each other while opening or closing the door. In this manner, the door can be opened or closed smoothly and at the same time, the damage to the seal member is prevented.

Apart from the above, there has been proposed a technique in which the seal member does not slide at all times but it is made abut against the other member by an actuator only when a fire occurs, for example, in Jpn. Pat. Appln. KOKAI Publication No. 2003-34481. According to this document, the attracting force of an electromagnet is released in reply to an output made by a smoke sensor, and the gap shut member is pushed out with a spring to shut the gap.

Further, Jpn. Pat. Appln. KOKAI Publication No. 7-247086 discloses a technique that provides a smoke shutting mechanism that bends in a labyrinth-like manner around the door. This mechanism is designed to interrupt the smoke by making the gap into a labyrinth-like form. With this mechanism, there is not sliding portion, and therefore the seal member is never worn out.

However, the invention having the configurations disclosed in Jpn. Pat. Appln. KOKAI Publication No. 6-234488 or 7-76477 requires an extra space in the installation in the height direction, for inclining the seal member. Therefore, it is difficult to carry out the reform of adding the smoke shutting mechanism to an already installed door while retaining the measurements of the already installed door and its guide mechanism. Further, since the seal member is set inclined, it is difficult to appropriately adjust the pressing force and contact area both of the seal members provided for the doorstop of the door and the inclined seal member.

As a result, it takes a lot of time and labor to adjust the seal member. Further, with these inventions, the inclined seal member is pressed, and therefore a component of force is created in the direction in which the door is opened, by means of the reactive force of the seal member. Consequently, it requires a large force to close the door and maintain the door closed. As a result, the driving mechanism and the mechanism for closing the door are increased in size.

The mechanism disclosed in Jpn. Pat. Appln. KOKAI Publication No. 2003-34481 requires a large space for installing the actuator. Further, this mechanism requires, for example, a control device for processing output signals from the smoke sensor, a wiring for the actuator and a recovery mechanism that is used to recover the mechanism after the sealing mechanism has been operated due to a power failure, an error by the smoke sensor, etc. Hence, the device becomes complicated.

In the mechanism disclosed in Jpn. Pat. Appln. KOKAI Publication No. 7-247086, the gap must be sufficiently narrow in order for the smoke shutting function to work appropriately. To maintain the narrow gap, high-precision parts are required. This mechanism, if installed not precisely, creates noise when members slide on each other, and therefore it is very difficult to adjust the set positions of the members when installed.

BRIEF SUMMARY OF THE INVENTION

According to the present invention, there is provided a highly durable sealing device for an elevator door that is free of possibilities of wear-out of the seal member and an excessive frictional force, which requires a small installation space, easily adjustment and no wiring operation or a control device, and does not create an excessive reactive force or large noise of sliding when closing the door.

An embodiment of the sealing device according to the present invention includes a doorway member, a door, a movable member, a push down mechanism and a sealing mechanism. The doorway member is provided for a gate of an elevator. The door is provided adjacent to the doorway, and it is opened and closed with respect to the doorway member. The movable member is set horizontally and provided to be movable in a vertical direction for the doorway. The movable member is elastically urged upwards by urging means. The push-down mechanism pushes down the movable member downwards against the force of the urging means immediately before the door is closed after the door moves in the direction in which the door is closed. The sealing mechanism is maintained in a non-contact state with respect to the door when the door is moving, and seals the gap between the door and the doorway member as it is brought into contact with the upper section of the door by the operation of the movable member when it is pushed down by the push down mechanism.

In this case, the sealing mechanism includes a belt-like seal member made of an elastic member, which is set horizontally in the doorway member. The seal member is stretched while the door is open. When the movable member is pushed downwards by the push-down mechanism, the seal member bends its vertical mid portion to bring the portion into contact with the upper section of the door. In this manner, the gap between the door and the doorway member is shut.

Alternatively, the sealing mechanism includes a belt-like seal member made of an elastic member, which is set horizontally in the doorway member. When the movable member is pushed downwards by the push-down mechanism, the seal member bends to bring itself into contact with the upper section of the door. Thus, the gap between the door and the doorway member is shut.

Alternatively, the sealing mechanism includes a belt-like seal member made of an elastic member, which is set horizontally on the movable member. When the movable member is pushed downwards by the push-down mechanism, the seal member is brought into contact with the upper section of the door and the doorway member to bridge therebetween. Thus, the gap between the door and the doorway member is shut.

In another embodiment, the push-down mechanism includes a cam member and a push member. The cam member is provided for either one of the doorway member and door, and the push member is provided for the other. Immediately before the door is closed, the cam member and the push member engage with each other to push the movable member downwards.

The seal member of the sealing mechanism is made of one of a rubber sheet, a noncombustible rubber sheet, a film-like resin material and a thin metal plate.

DETAILED DESCRIPTION OF THE INVENTION

Figure 1:
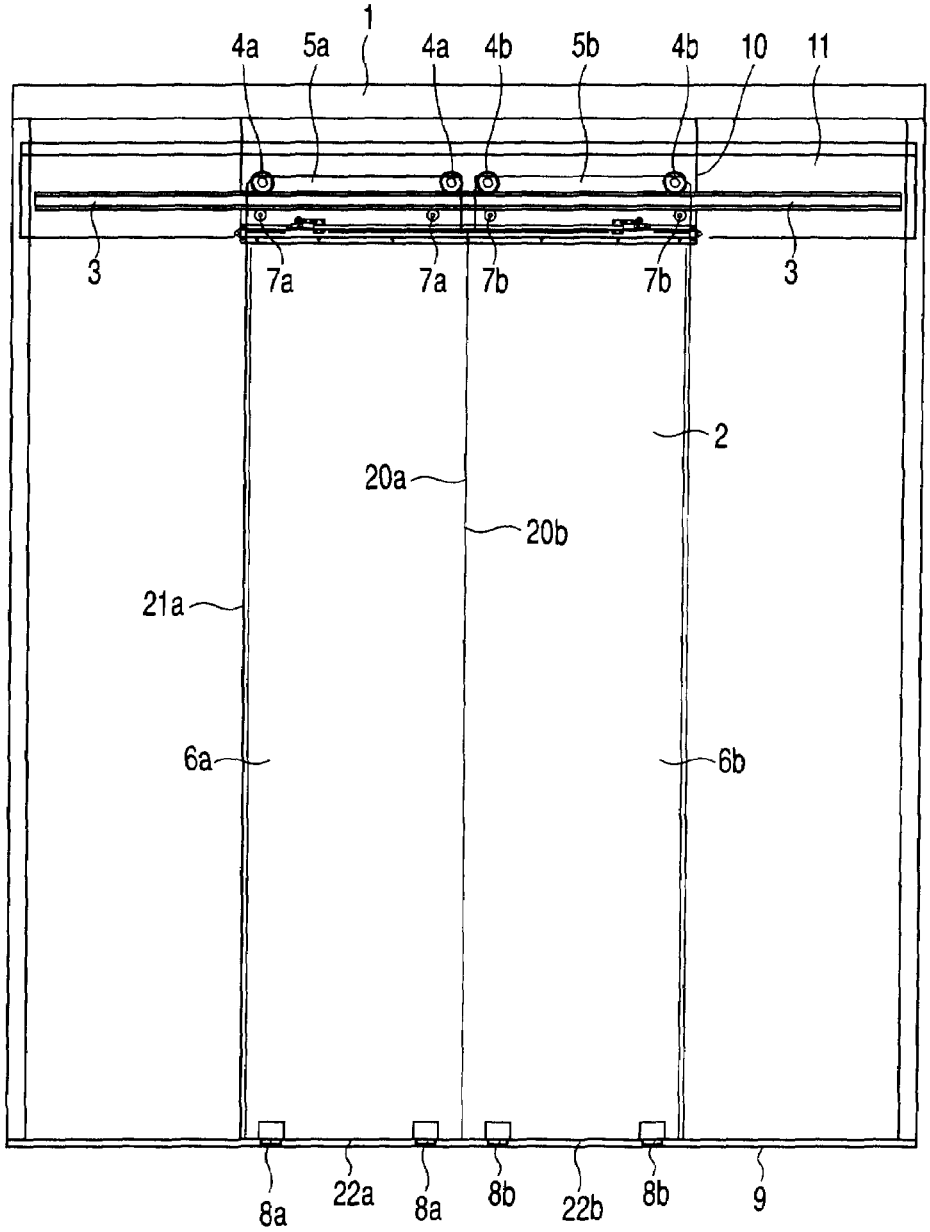
FIG. 1 is a perspective front view of a door device of an elevator gate according to the first embodiment of the present invention when viewed from an elevator shaft side.

The first embodiment of the present invention will now be described with reference to FIGS. 1 to 10. As shown in FIG. 1, a gate of an elevator comprises a frame body 1 serving as a doorway member to surround an opening portion 2 of an elevator shaft wall. A hanger rail 3 is installed in an upper section of the frame body 1 in a horizontal direction.

A pair of hall doors 6*a* and 6*b* are suspended from the hanger rail 3 by means of hanger rollers 4*a* and 4*b* and hangers 5*a* and 5*b*. The hall doors 6*a* and 6*b* move symmetrically to left and right along the hanger rail 3.

In order to prevent the hanger rollers 4*a* and 4*b* from coming off the rail, lower side support rollers 7*a* and 7*b* are arranged on the lower side of the hanger rail 3, and they are rotatably mounted on the hangers 5*a* and 5*b*, respectively.

The lower portions of the hall doors 6*a* and 6*b* are guided along a doorsill 9 provided to be substantially flush with the floor of the hall, by means of guide shoes 8*a* and 8*b*. Of the surrounding portions of the hall doors 6*a* and 6*b*, doorstop portions 20*a* and 20*b*, door rear end portions 21*a* and 21*b* and doorsill portions 22*a* and 22*b* are each provided a built-in sealing mechanism that constitutes sealing means.

Figure 2:
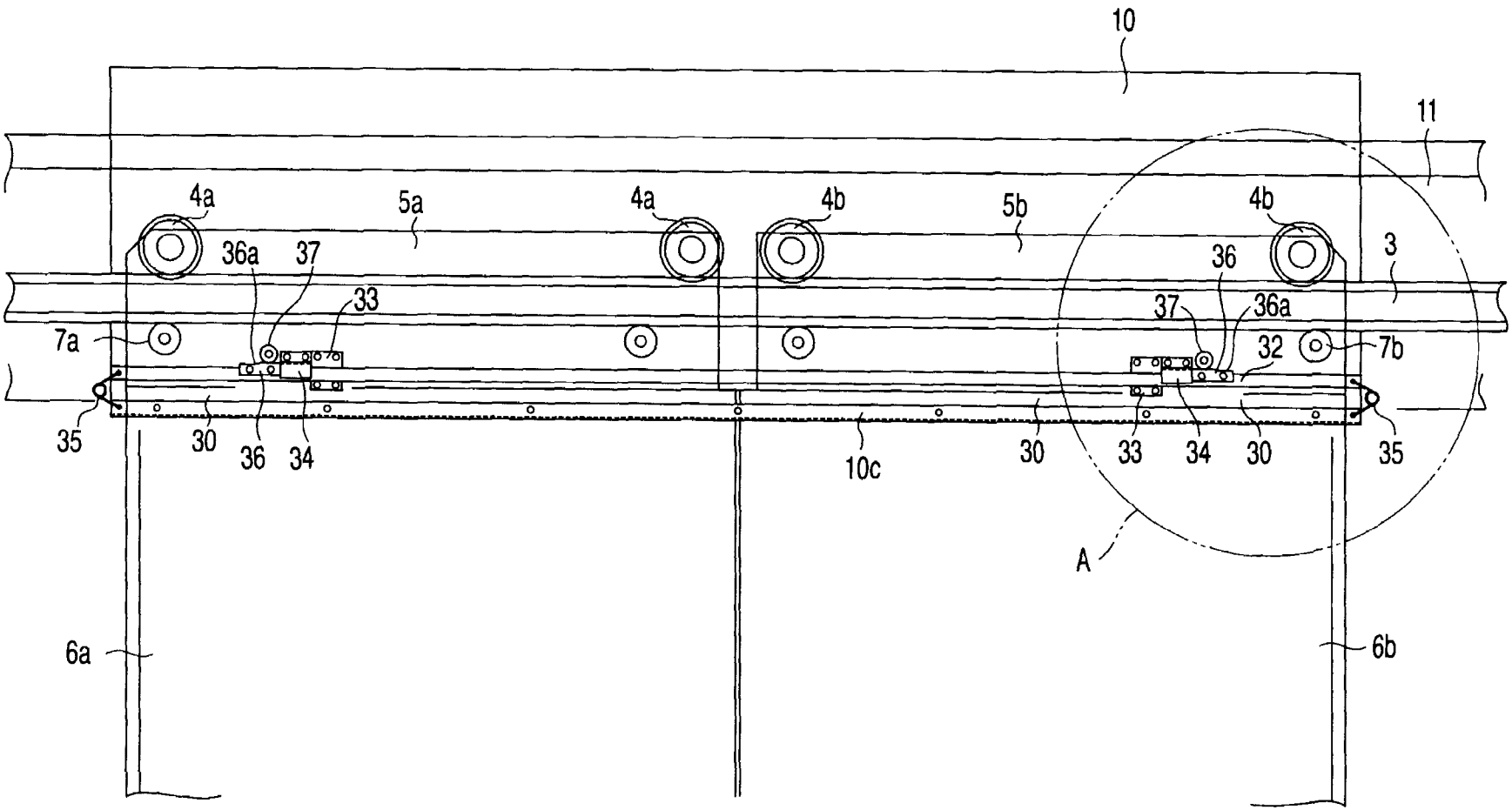
FIG. 2 is an enlarged view of a part of the door device shown in FIG. 1.
Figure 3:
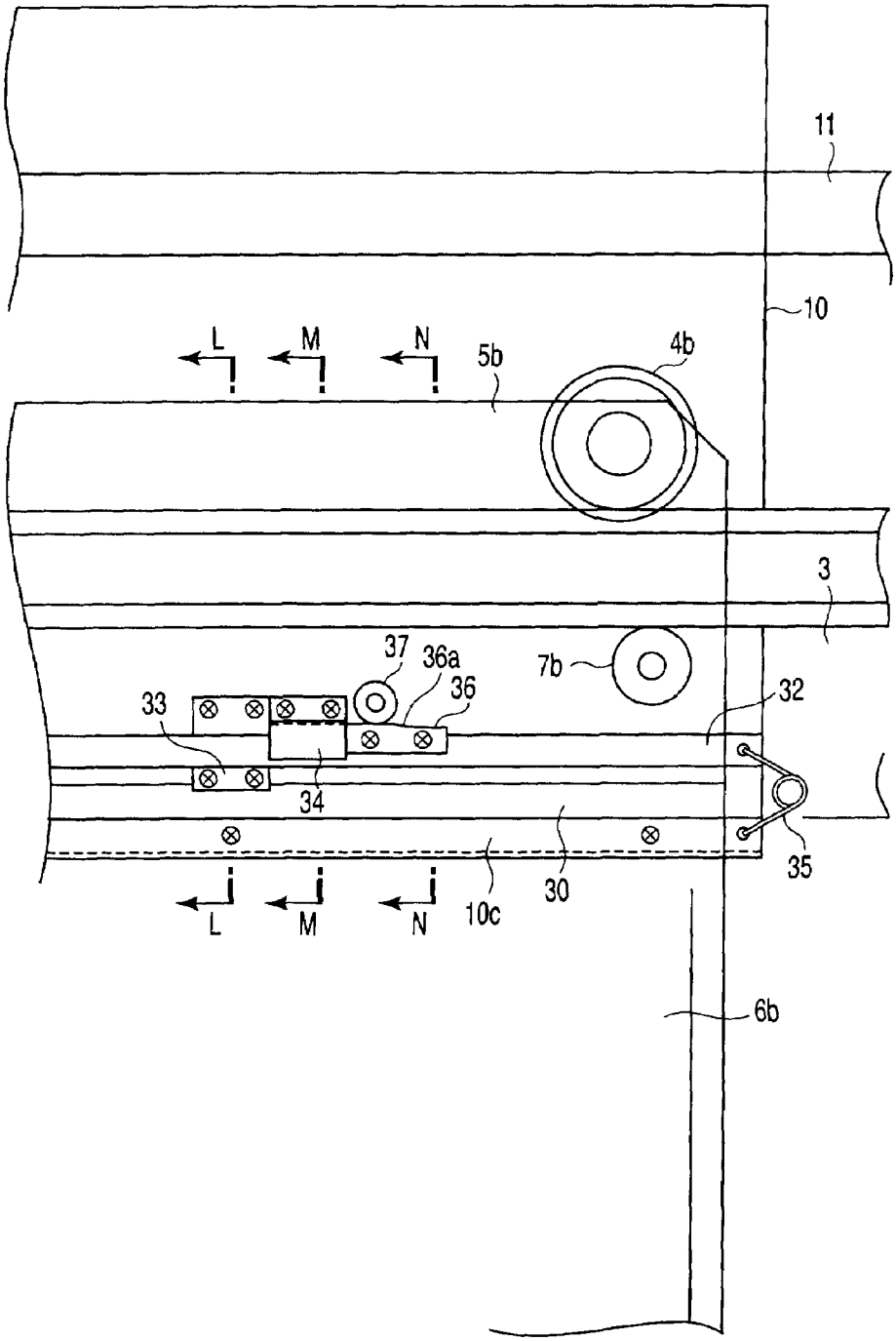
FIG. 3 is a further enlarged view of the part of the door device shown in FIG. 1.
Figure 4:
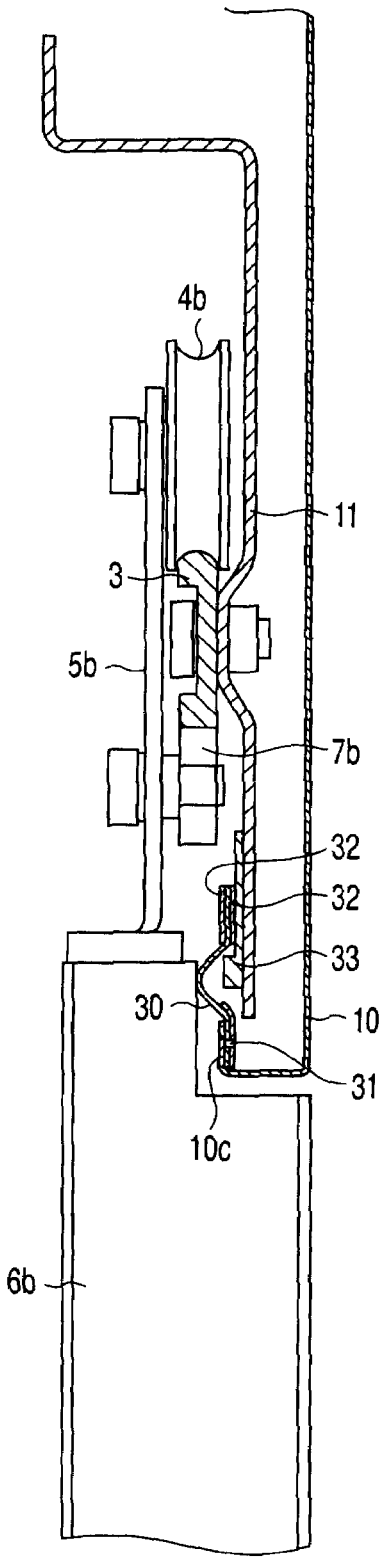
FIG. 4 is a cross sectional diagram taken along the line L-L indicated in FIG. 3.
Figure 5:
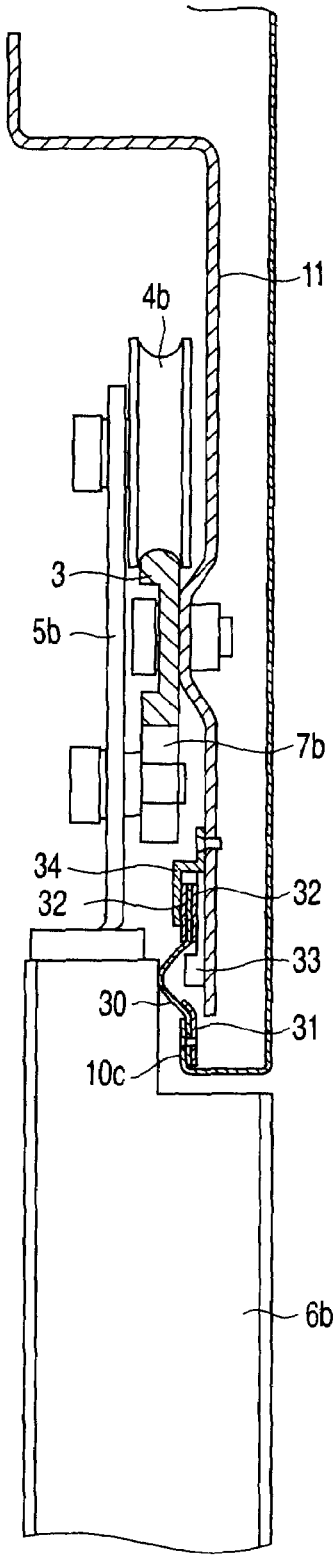
FIG. 5 is a cross sectional diagram taken along the line M-M indicated in FIG. 3.
Figure 6:
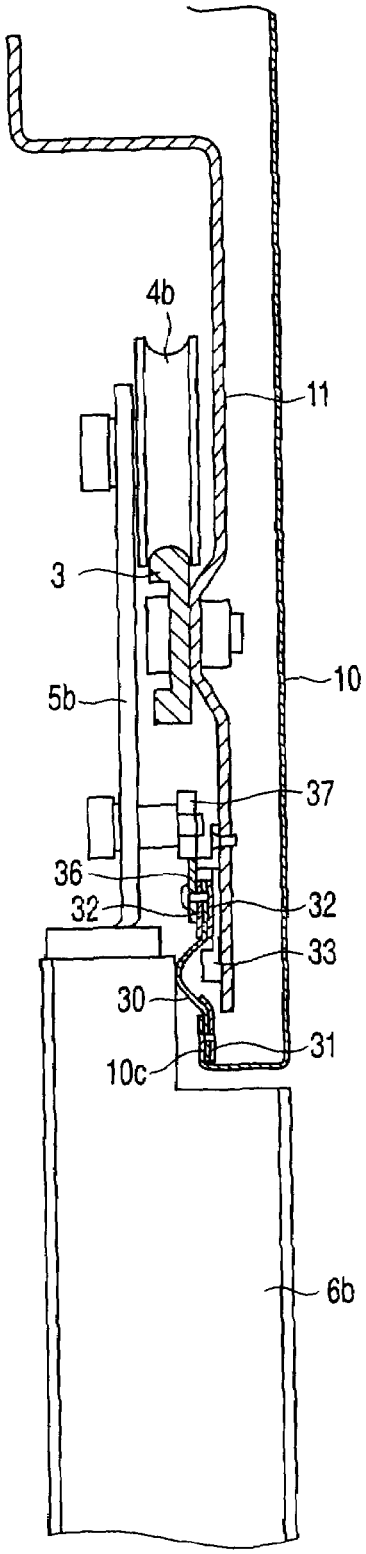
FIG. 6 is a cross sectional diagram taken along the line N-N indicated in FIG. 3.
Figure 7:
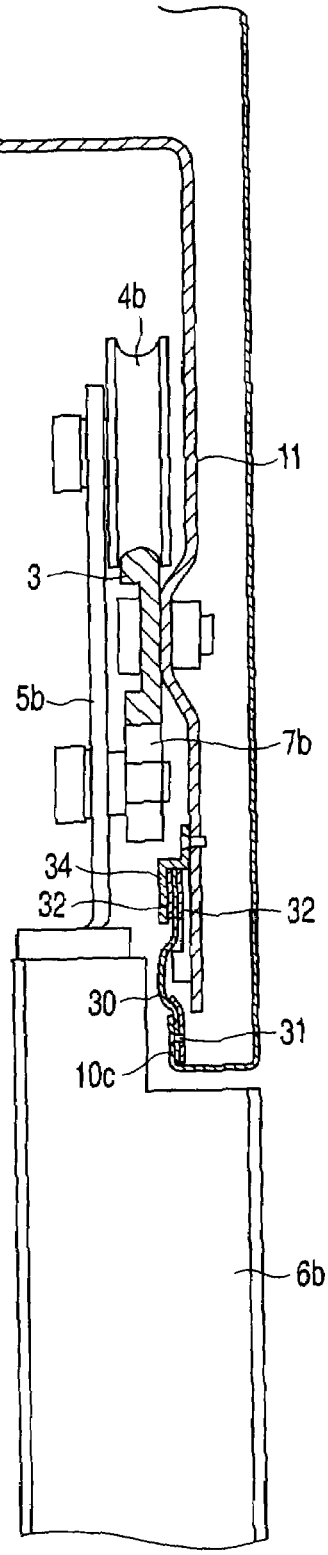
FIG. 7 is a cross sectional diagram illustrating the door device shown in FIG. 1 while the door is open.

Next, the sealing mechanisms provided for the upper sections of the hall doors 6*a* and 6*b* will now be described in details with reference to FIGS. 2 to 5. FIG. 2 is a diagram showing an enlarged view of the upper sections of the hall doors 6*a* and 6*b* shown in FIG. 1. FIG. 3 is a diagram showing a further enlarged view of the section A indicated in FIG. 2. FIGS. 4 to 6 are cross sectional views taken along the lines L-L, M-M and N-N, respectively, in FIG. 3. In FIGS. 4 to 6, the hall is located on the right-hand side of the figure, and the elevator shaft side is located on the left-hand side.

As shown in FIGS. 2 to 4, a door header 10 serving as a doorway member is provided to face the hall side for the upper sides of the hall doors 6*a* and 6*b*. The door header 10 is connected to the frame body 1.

A folded portion 10*c* is formed at a lower edge of the door header 10, and it is folded into an L shape towards the shaft side to face the upper sections of the hall doors 6*a* and 6*b*. A header case 11 is connected to the frame body 1 and provided in an inner side of the door header 10. The hanger rail 3 is mounted on the header case 11. The lower end portion of the header case 11 reaches near the folded portion 10*c* at the lower end portion of the door header 10.

A belt-like fluorine-based rubber sheet 30 serving as a seal member is provided horizontally along the longitudinal direction of the folded portion 10*c* across between the lower end portion of the header case 11 and the folded portion 10*c* of the door header 10. A lower end portion of the rubber sheet 30 is pinched between a lower holder plate 31 and the folded portion 10*c*, thus fixing it to the folded portion 10*c*. An upper end portion of the rubber sheet 30 is pinched between two upper holder plates 32 serving as movable members.

A back support plate 33 and a front support plate 34, each formed of a synthetic resin, are mounted on an inner side of the lower end portion of the header case 11. As shown in FIG. 2, the back support plate 33 and front support plate 34 are mounted in such a manner that they are displaced with each other in the longitudinal direction in a longitudinal mid zone of the header case 11. The upper end portion of the rubber sheet 30 is inserted to be slidable in a vertical direction together with the upper holder plate 32 between the back support plate 33 and front support plate 34.

Torsion springs 35 serving as the urging means are attached between end portions of the upper holder plate 32 and lower holder plate 31 on both sides. The upper holder plate 32 is elastically urged upwards by the torsion springs 35. Cam plates 36 serving as the cam members are symmetrically attached to sections near the end portions of the upper holder plate 32 on both sides. Cam rollers 37 that serve as push members and correspond to the cam plates 36, respectively, are rotatably set to the hanger 5*a* and 5*b* of the hall door 6*a* and 6*b*.

An upper edge of each of the cam plates 36 is formed into a cam portion 36*a* that has an uneven height. The cam roller 37 comes into contact with the cam portion 36*a* just before the hall doors 6*a* and 6*b* are closed, and it moves up to the high section of the cam portion 36*a* from the low section. Thus, the rubber sheet 30 is pushed downwards together with the upper holder plate 32 against the force of the torsion springs 35.

The operation of this embodiment will now be described. When the hall doors 6*a* and 6*b* are open, the cam rollers 37 are located away from the respective cam plates 36, and the upper holder plate 32 is pushed upwards by the elastic force of the torsion springs 35. The upper end of the upper holder plate 32 is made to abut the upper end of the inner side of the front support plate 34, and thus the rubber sheet 30 is stretched to maintain its non-contact state with respect to the hall doors 6*a* and 6*b*. (See FIG. 7.)

From this state, the hall doors 6*a* and 6*b* are moved in such a direction that they become closer to each other to close the door. While moving the doors, the rubber sheet 30 maintains its stretched state until just before the doors are closed. Just before the hall doors 36*a* are closed, each of the cam rollers 37 comes into contact with the cam portion 36*a* of the respective cam plate 36, and moves up to the high section of the cam portion 36*a* from the low section. Consequently, the upper section of the rubber sheet 30 is pushed down together with the upper holder plate 32 against the force of the torsion springs 35. (See FIGS. 2 to 6.)

As the rubber sheet 30 is pushed down, the vertical mid portion of the rubber sheet 30 is elastically bent to project to the shaft side. The mid portion of the rubber sheet 30, as it is bent, is brought into tight contact with the upper sections of the hall doors 6*a* and 6*b*. As a result, the gap between the door header 10 and the upper sections of the hall doors 6*a* and 6*b* is shut in an airtight state.

As described above, the gap between the door header 10 and the upper sections of the hall doors 6*a* and 6*b* is shut with the rubber sheet 30 in an air tight state, and therefore the flow of the air from an elevator hall to the shaft is shut off. In this manner, the smoke of a fire cannot enter the shaft from the elevator hall. Thus, the sealing device of this embodiment can prevent the shaft from serving as a chimney, thereby suppressing the spreading of the fire. Further, the diffusion of the smoke to some other floor can be prevented.

Further, according to the sealing device of this embodiment, the sealing mechanism can be installed in a small space with regard to its height direction as well as its thickness direction. Therefore, the sealing mechanism can be installed in an already built hall door without requiring a large-scale reform in its renewal construction.

The rubber sheet 30 of the sealing mechanism does not slide on the hall doors 6*a* and 6*b* that are opened and closed, but it is brought into contact with these just before the doors are closed. With this operation, the rubber sheet 30 is not easily worn out, and stands up to long use. Further, the frictional force during sliding and the reactive force after the doors are closed can be reduced to extremely low levels. Furthermore, the sealing mechanism does not require an actuator or wiring, hence the installation and adjustment are easy.

This embodiment is directed to a door device of biparting type in which doorstop portions of a pair of hall doors 6*a* and 6*b* are located at a central portion of the gate and the hall doors 6*a* and 6*b* are opened or closed symmetrically in a horizontal direction with respect to the center. It is also possible to apply a similar mechanism to a door device of one side sliding type that includes a high-speed door and a low-speed door.

Figure 8:
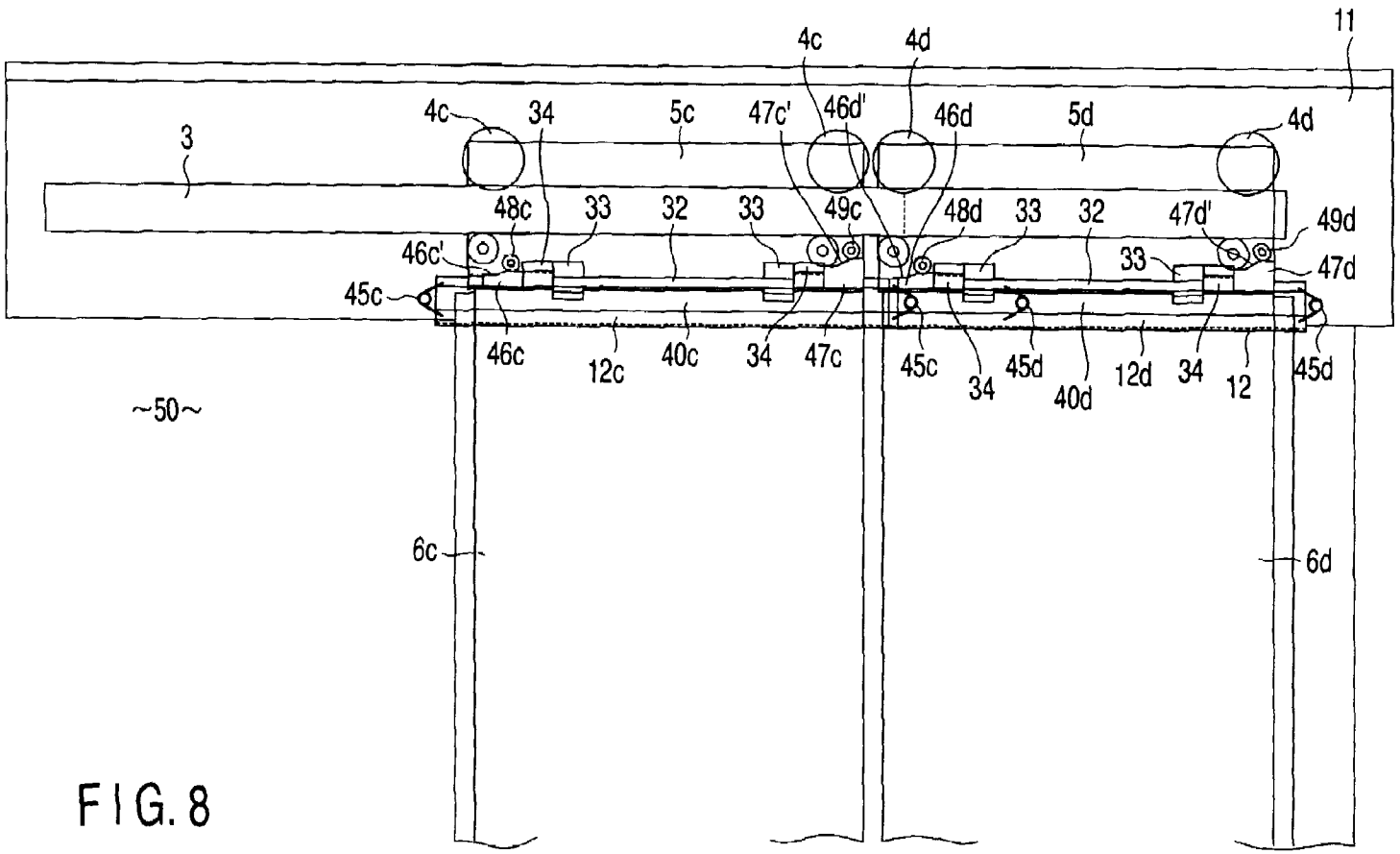
FIG. 8 is a perspective front view of a door device of an elevator gate according to the second embodiment of the present invention when viewed from the elevator shaft side.

The second embodiment of the present invention will now be described in connection with a case where the present invention is applied to a door device of the one side sliding type with reference to FIGS. 8 to 12. FIG. 8 is a perspective front view of upper sections of hall doors 6*c* and 6*d* of the one side sliding type, viewed from the shaft side. FIGS. 9 to 12 are cross sectional views illustrating the structure of the door device with the respective parts. From FIGS. 9 to 12, the hall side is located on the right-hand side of the figure and the shaft side is located on the left-hand side of the figure.

As shown in FIG. 8, the low-speed hall door 6*c* and the high-speed hall door 6*d* are arranged to be displaced from each other in front and rear positions. FIG. 8 shows a state in which the hall doors 6*c* and 6*d* are closed. While opening the hall doors 6*c* and 6*d* from this state, the low-speed hall door 6*c* moves at a low speed towards a door case 50 on the left-hand side of the figure, and the high-speed hall door 6*d* moves at a high speed towards the door case 50. The hall doors 6*c* and 6*d* are arranged to overlap one on the other in front and rear positions within the door case 50. In such state, the gate is opened.

As shown in FIGS. 9 to 12, the hanger rails 3 in pair are provided in parallel with the header case 11. The hanger 5*c* of the low-speed hall door 6*c* is suspended from one of the hanger rails 3 via the hanger roller 4*c*, whereas the hanger 5*d* of the high-speed hall door 6*d* is suspended from the other one of the hanger rails 3 via the hanger roller 4*d*. Each of the hall doors 6*c* and 6*d* moves along the respective one of the hanger rails 3.

The door header 12 has a stepped section at a horizontal mid portion. The door header 12 has the folded portion 12*c* on the left-hand side with respect to the stepped section in FIG. 8 and the folded portion 12*d* on the right-hand side to the stepped section. The folded portion 12*c* is located near the upper section of the low-speed hall door 6*c* to face it. The folded portion 12*d* is located near the upper section of the high-speed hall door 6*d* to face it.

Figure 9:
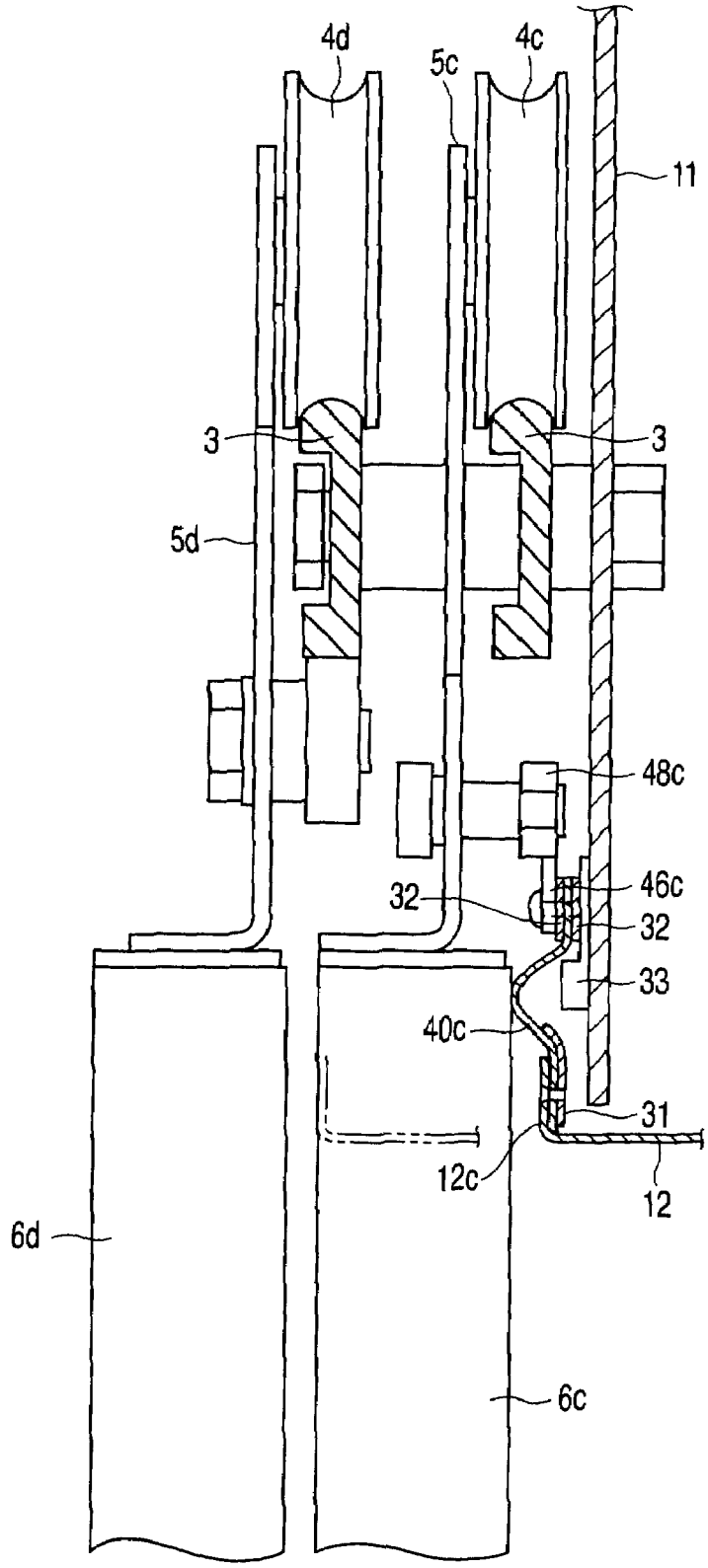
FIG. 9 is a cross sectional view of a part of the door device shown in FIG. 8.
Figure 10:
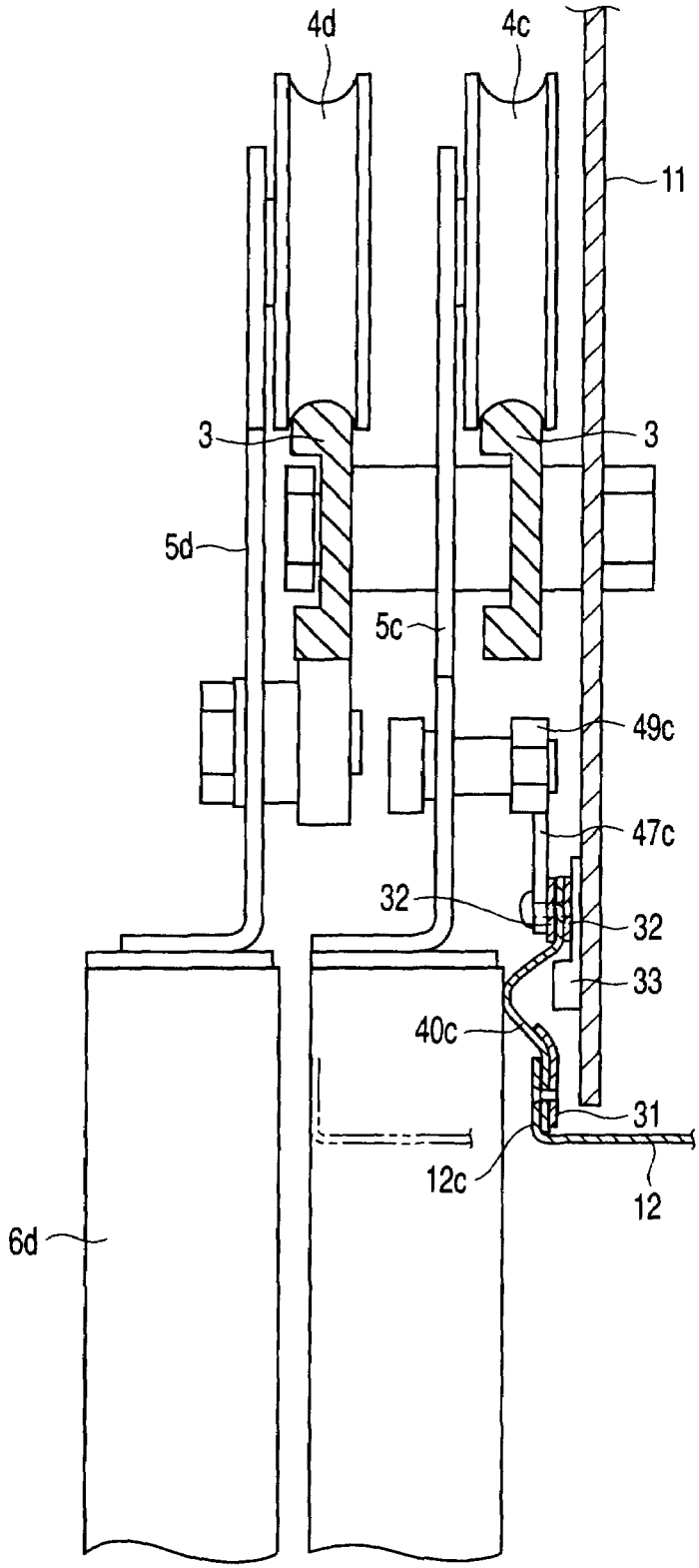
FIG. 10 is a cross sectional view of another part of the door device shown in FIG. 8.

As shown in FIGS. 9 and 10, the belt-like fluorine-based rubber sheet 40*c* is provided horizontally along the longitudinal direction of the folded portion 12*c* between the folded portion 12*c* of the door header 12 and the lower end portion of the header case 11.

The lower end portion of the rubber sheet 40*c* is pinched between the lower holder plate 31 and the folded portion 12*c* to be fixed to the folded portion 12*c*. The upper end portion of the rubber sheet 40*c* is pinched between the two upper holder plates 32 serving as movable members.

The back support plate 33 and front support plate 34, each formed of a synthetic resin, are attached to the inner surface of the lower end portion of the header case 11. The upper end portion of the rubber sheet 40*c* is inserted to be slidable in the vertical direction, together with the upper holder plates 32 between the back support plate 33 and front support plate 34. As shown in FIG. 8, the torsion springs 45*c* are set between the ends of the upper holder plate 32 and the lower holder plate 31 on both sides, respectively. The upper holder plate 32 is elastically urged upwards by the torsion springs 45*c*.

The upper holder plate 32 is provided with the cam plates 46*c* and 47*c* on both end sides, respectively. The cam rollers 48*c* and 49*c* corresponding to the cam plates 46*c* and 47*c* are rotatably attached on the hanger 5*c* of the hall door 6*c*.

The upper edges of the cam plates 46*c* and 47*c* are formed into cam portions 46*c*' and 47*c*' each having uneven height. Just before the hall door 6*c* is closed, the cam rollers 48*c* and 49*c* come into contact with the cam portions 46*c*' and 47*c*', and move up to the high sections of the cam portions 46*c*' and 47*c*' from the low sections. Consequently, the rubber sheet 40*c* is pushed downwards together with the upper holder plate 32 against the force of the torsion springs 45*c*.

As shown in FIG. 8, the cam portion 46*c*' of the cam plate 46*c*, which is one of the cam plates 46*c* and 47*c* corresponding to the hall door 6*c*, that is located on the door case 50 side, is placed to a level lower than that of the cam portion 47*c*' of the other cam plate 47*c* that is located on the doorstop side. The cam roller 48*c* corresponding to the cam plate 46*c* is placed to a level lower than that of the cam roller 49*c* corresponding to the cam plate 47*c*. In this manner, when the hall door 6*c* is moved in the direction to close the door, the cam roller 49*c* located on the doorstop side passes the cam plate 46*c* on the door case 50 side without being brought into contact with it. Then, just before the door is closed, the cam rollers 48*c* and 49*c* come into contact with the cam portions 46*c*' and 47*c*' of the cam plates 46*c* and 47*c*, respectively.

Figure 11:
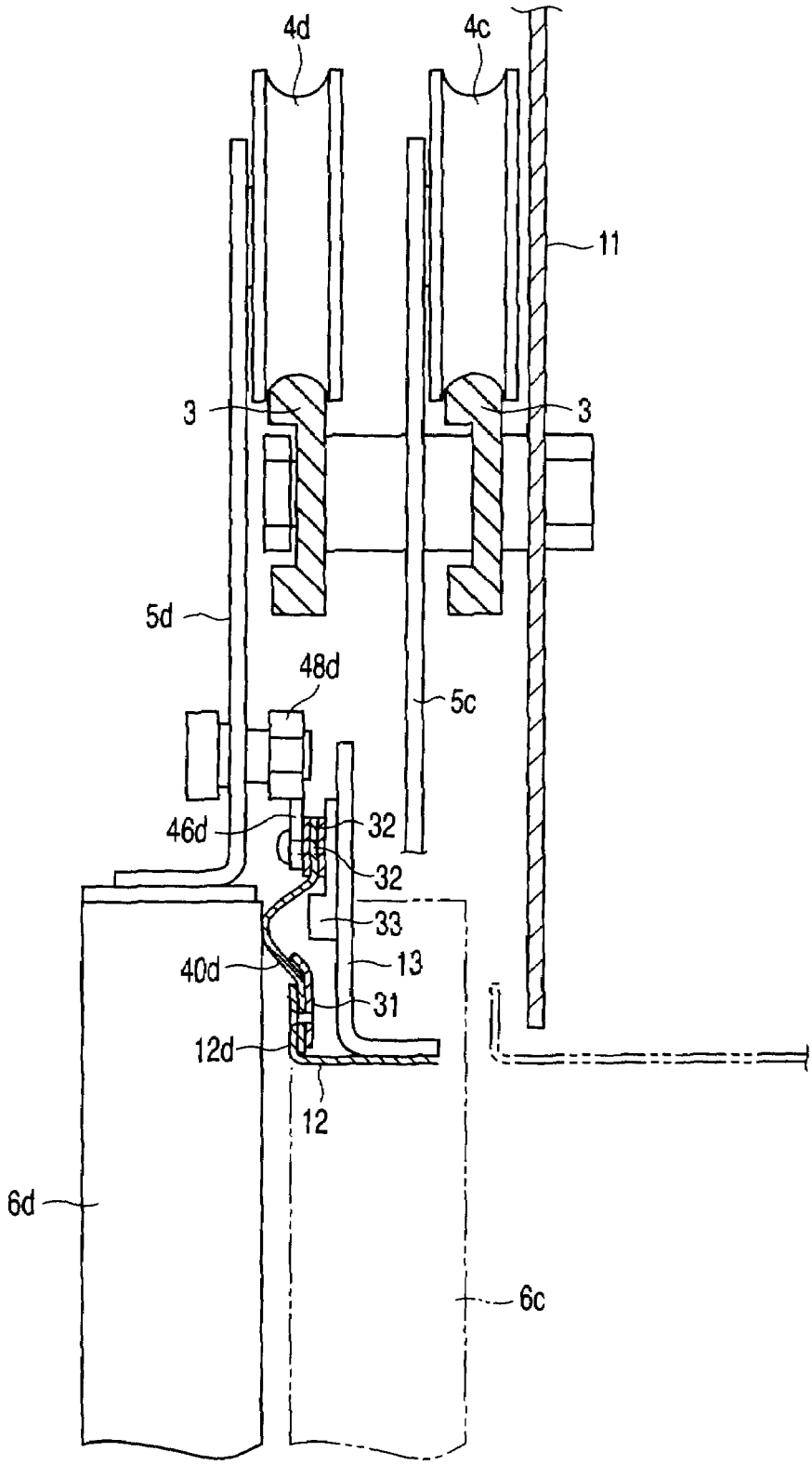
FIG. 11 is a cross sectional view of still another part of the door device shown in FIG. 8.
Figure 12:
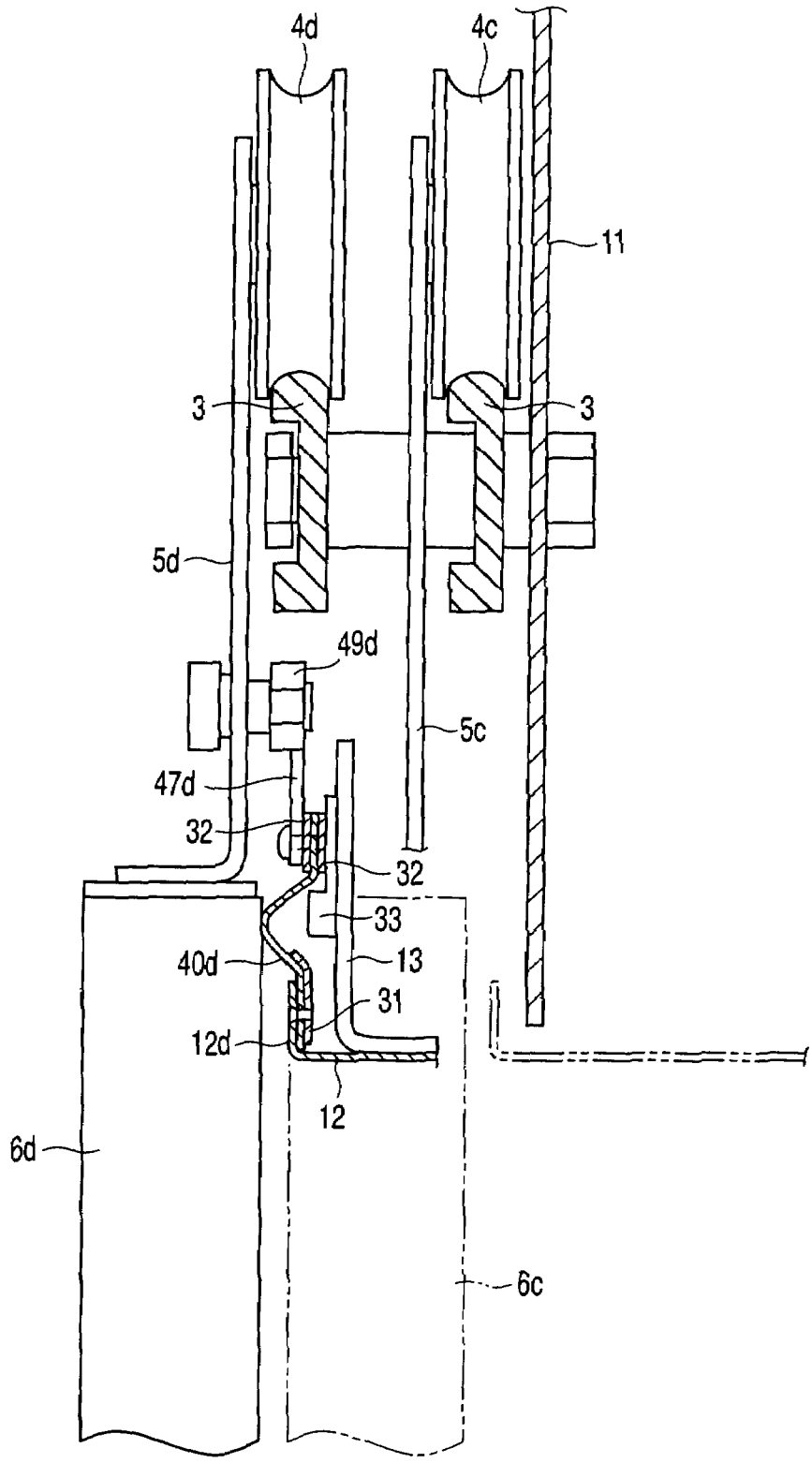
FIG. 12 is a cross sectional view of still another part of the door device shown in FIG. 8.

As shown in FIGS. 11 and 12, the belt-like fluorine-based rubber sheet 40*d* is provided horizontally along the longitudinal direction of the folded portion 12*d* between the folded portion 12*d* of the door header 12, which faces the upper section of the high-speed hall door 6*d*, and the lower end portion of the header case 11.

The lower end portion of the rubber sheet 40*c* is pinched between the lower holder plate 31 and the folded portion 12*d* to be fixed to the folded portion 12*d*. The upper end portion of the rubber sheet 40*d* is pinched between the two upper holder plates 32 serving as movable members.

A stand plate 13 is mounted on an inner side of the folded portion 12*d* of the door header 12, to stand facing the folded portion 12*d*. The back support plate 33 and front support plate 34, each formed of a synthetic resin, are attached to a side surface of the stand plate 13. The upper end portion of the rubber sheet 40*d* is inserted to be slidable in the vertical direction, together with the upper holder plates 32 between the back support plate 33 and front support plate 34.

As shown in FIG. 8, the torsion springs 45*d* are set between the upper holder plate 32 and the lower holder plate 31. The upper holder plate 32 is elastically urged upwards by the torsion springs 45*d*.

The cam plate 46*d* and 47*d* are respectively attached near both end sides of the upper holder plate 32. The cam rollers 48*d* and 49*d* corresponding to the cam plates 46*d* and 47*d* are rotatably attached on the hanger 5*d* of the hall door 6*d*.

The upper edges of the cam plates 46*d* and 47*d* are formed into cam portions 46*d*' and 47*d*' each having uneven height. Just before the hall door 6*d* is closed, the cam rollers 48*d* and 49*d* come into contact with the cam portions 46*d*' and 47*d*', and move up to the high sections of the cam portions 46*d*' and 47*d*' from the low sections. Just before the hall door 6*d* is closed, the cam rollers 48*d* and 49*d* come in to contact with the cam portions 46*d*' and 47*d*' from the low sections of the cam portions. Consequently, the rubber sheet 40*d* is pushed downwards together with the upper holder plate 32 against the force of the torsion springs 45*d*.

The cam portion 46*d*' of the cam plate 46*d*, which is one of the cam plates 46*d* and 47*d* corresponding to the hall door 6*d*, that is located on the door case 50 side, is placed to a level lower than that of the cam portion 47*d*' of the other cam plate 47*d* that is located on the doorstop side. The cam roller 48*d* corresponding to the cam plate 46*d* is placed to a level lower than that of the cam roller 49*d* corresponding to the cam plate 47*d*. In this manner, when the hall door 6*d* is moved in the direction to close the door, the cam roller 49*d* located on the doorstop side passes the cam plate 46*d* on the door case 50 side without being brought into contact with it. Then, just before the door is closed, the cam rollers 48*d* and 49*d* come into contact with the cam portions 46*d*' and 47*d*' of the cam plates 46*d* and 47*d*, respectively.

The operation of this embodiment will now be described. When the hall doors 6*c* and 6*d* are placed in the door case 50 to open the gate, the upper holder plates 32 of the rubber sheets 40*c* and 40*d* are pushed upwards by the elastic force of the torsion springs 45*c* and 45*d*. The upper ends of the upper holder plates 32 are made to abut the upper end of the inner side of the front support plate 34. In this state, the rubber sheets 40*c* and 40*d* are stretched to maintain its non-contact state with respect to the hall doors 6*c* and 6*d*.

Even when the hall doors 6*c* and 6*d* start to move towards the doorstop side to close the gate, the rubber sheets 40*c* and 40*d* maintain their stretched states until the doors are completely closed. Just before the hall doors 6*c* and 6*d* are completely closed, the cam rollers 48*c*, 49*c*, 48*d* and 49*d* come into contact with the cam portions 46*c*', 47*c*', 46*d*' and 47*d*' of the cam plates 46*c*, 47*c*, 46*d* and 47*d*, respectively, and move up to the high sections of the cam portions 46*c*', 47*c*', 46*d*' and 47*d*' from the low sections. Due to this shifting, the upper portions of the rubber sheets 40*c* and 40*d* are pushed down together with the upper holder plates 32 against the force of the torsion springs 45*c* and 45*d*.

As the rubber sheets 40*c* and 40*d* are pushed down, the vertical mid portion of each of the rubber sheets 40*c* and 40*d* is elastically bent to project to the shaft side. Thus, the mid portions of the rubber sheets 40*c* and 40*d* are brought into tight contact with the upper sections of the hall doors 6*c* and 6*d*. As a result, the gap between the door header 12 and the upper sections of the hall doors 6*c* and 6*d* is shut in an airtight state.

As described above, the gap between the door header 12 and the upper sections of the hall doors 6*c* and 6*d* is shut with the rubber sheets 40*c* and 40*d* in an airtight state, and therefore the flow of the air from an elevator hall to the shaft is shut off. In this manner, the smoke of a fire cannot enter the shaft from the elevator hall. Thus, the sealing device of this embodiment can prevent the shaft from serving as a chimney, thereby suppressing the spreading of the fire. Further, the diffusion of the smoke to some other floor can be prevented.

Further, as in the case of the first embodiment, the sealing mechanism of this embodiment can be installed in a small space with regard to its height direction as well as its thickness direction. Therefore, the sealing mechanism can be installed in an already constructed building without requiring a large-scale reform in the elevator renewal construction.

Further, the rubber sheets 40*c* and 40*d* of the sealing mechanism do not at all times slide on the hall doors 6*c* and 6*d* that are opened and closed, but they are brought into contact with the doors just before they are completely closed. With this operation, the rubber sheets 40*c* and 40*d* are not easily worn out, and stands up to long use. Further, the frictional force during sliding and the reactive force after the doors are closed can be reduced to extremely low levels. Furthermore, an actuator or wiring is not required, and therefore the installation and adjustment are easy.

Figure 13:
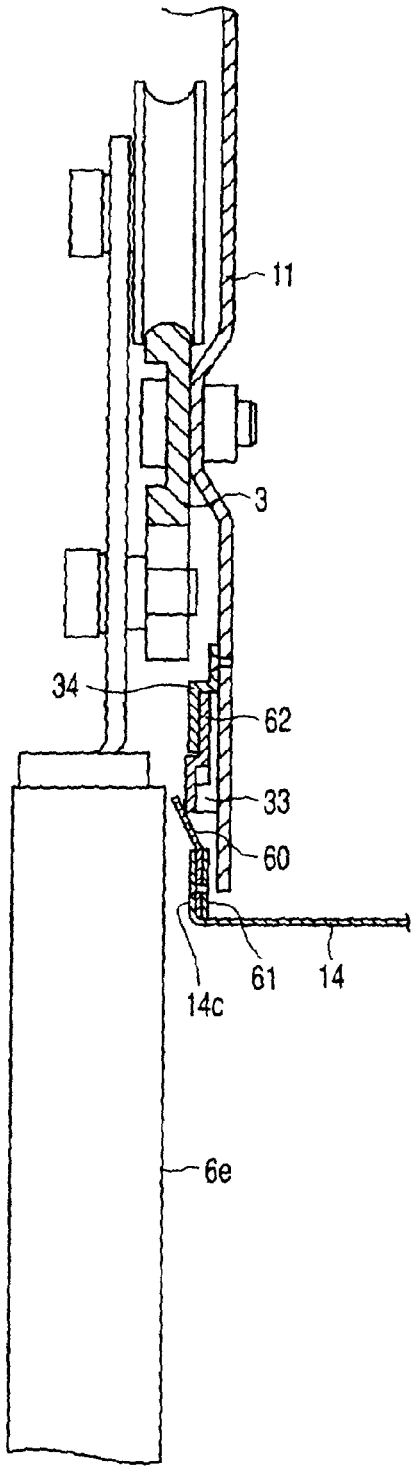
FIG. 13 is a cross sectional view of a part of a door device according to the third embodiment of the present invention.
Figure 14:
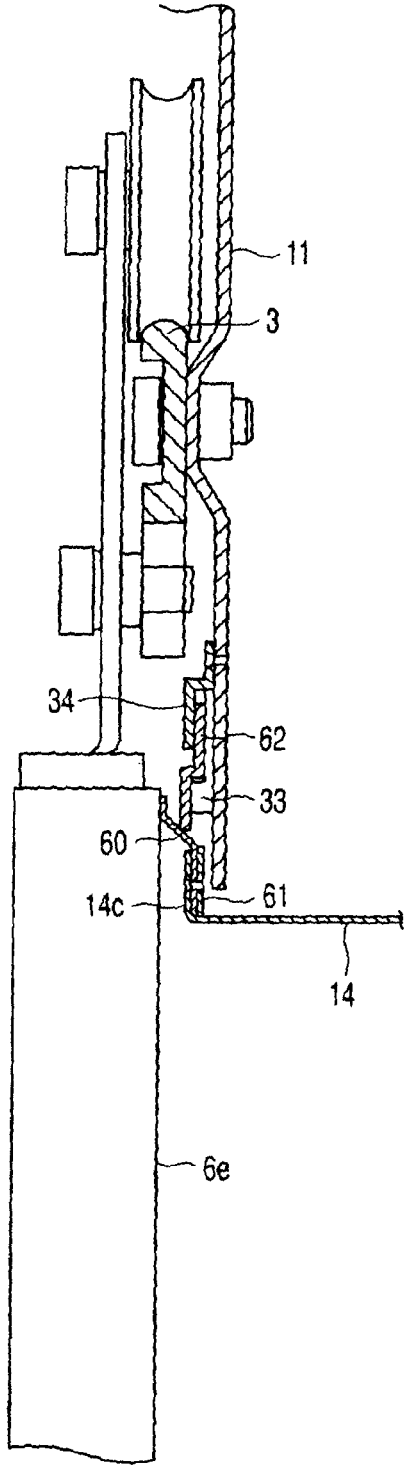
FIG. 14 is a cross sectional view of another part of the door device shown in FIG. 13.

The third embodiment of the present invention will now be described with reference to FIGS. 13 and 14. FIG. 13 is a cross sectional view illustrating the upper section of the hall door 6*e* while it is not completely closed, and FIG. 14 is a cross sectional view illustrating the upper section of the hall door 6*e* when it is completely closed.

A belt-like fluorine-based rubber sheet 60 is provided horizontally on the folded portion 14*c* of the door header 14 to extend along the longitudinal direction of the folded portion 14*c*. The lower end portion of the rubber sheet 60 is pinched between the lower holder plate 61 and the folded portion 14*c* to be fixed to the folded portion 14*c*. The upper end portion of the rubber sheet 60 is extended above the folded portion 14*c* to face the upper section of the hall door 6*e*.

The back support plate 33 and front support plate 34, each formed of a synthetic resin, are attached to the inner surface of the lower end portion of the header case 11. A holder plate 62 serving as a movable member is inserted to be slidable in the vertical direction between the back support plate 33 and front support plate 34. The lower edge of the holder plate 62 comes in contact with a side surface of the rubber sheet 60.

As in the case of the upper holder plate 32 in the first embodiment, the holder plate 62 is elastically urged upwards by a torsion spring serving as urging means. Then, just before the hall door 6*e* is closed, the holder plate 62 is pushed downwards against the force of the torsion spring by a cam mechanism similar to that of the case of the first embodiment.

In this embodiment, when the hall door 6*e* is opened, the holder plate 62 is elastically pushed upwards as shown in FIG. 13, thus maintaining a non-contact state in which the rubber sheet 60 is apart from the hall door 6*e*.

From this state, when the hall door 6*e* moves in such a direction to close the door and reach a position just before the door is completely closed, the holder plate 62 moves downwards as shown in FIG. 14. Consequently, the rubber sheet 60 is pushed downwards to elastically bend and the sheet is brought into tight contact with the upper section of the hall door 6*e*. As a result, the gap between the door header 14 and the upper section of the hall door 6*e* is shut in an airtight state.

In this manner, the flow of the air from an elevator hall to the shaft is shut off, and therefore the smoke of a fire cannot enter the shaft from the elevator hall. Thus, the sealing device of this embodiment can prevent the shaft from serving as a chimney, thereby suppressing the spreading of the fire. Further, the diffusion of the smoke to some other floor can be prevented.

Further, as in the case of the first embodiment, the sealing mechanism of this embodiment can be installed in a small space with regard to its height direction as well as its thickness direction. Therefore, the sealing mechanism can be installed in an already constructed building without requiring a large-scale reform in its renewal construction.

Further, the rubber sheet 60 of the sealing mechanism does not slide on the hall door 6*e* that is opened and closed, but it is brought into contact with the door just before it is completely closed. With this operation, the rubber sheet 60 is not easily worn out, and stands up to long use. Further, the frictional force during sliding and the reactive force after the door is closed can be reduced to extremely low levels. Furthermore, an actuator or wiring is not required, and therefore the installation and adjustment are easy.

Figure 15:
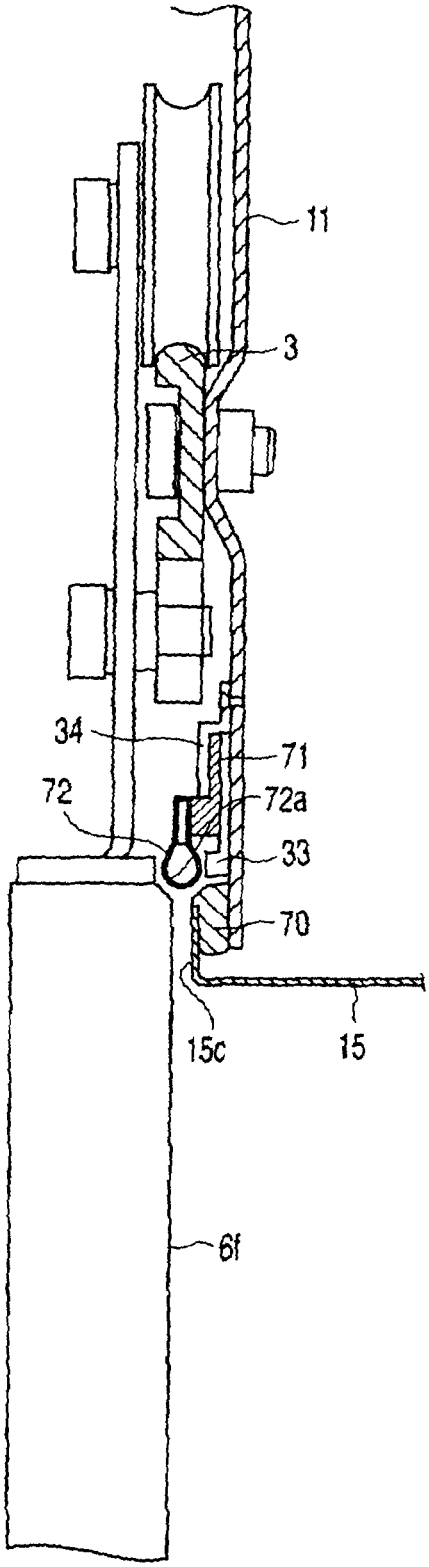
FIG. 15 is a cross sectional view of another part of the door device according to the fourth embodiment of the present invention.
Figure 16:
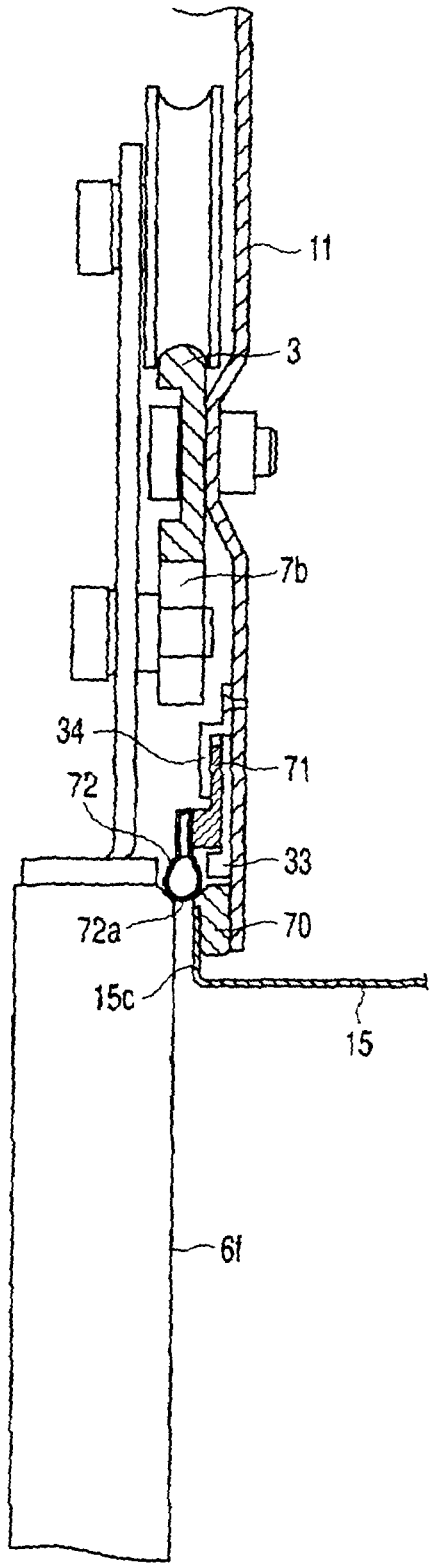
FIG. 16 is a cross sectional view of another part of the door device shown in FIG. 15.

The fourth embodiment of the present invention will now be described with reference to FIGS. 15 and 16. FIG. 15 is a cross sectional view illustrating the upper section of the hall door 6*f* just before it is closed, and FIG. 16 is a cross sectional view illustrating the upper section of the hall door 6*f* when it is completely closed.

In this embodiment, a filler member 70 is fit between a folded portion 15*c* of a door header 15 and the lower end portion of the header case 11, horizontally along the longitudinal direction of the folded portion 15*c*. The upper portion of the filler member 70 is exposed from the upper end of the folded portion 15*c* and faces the hall door 6*f*. Corner portions of the filler member 70 and the hall door 6*f*, which faces each other, are each formed a chamfer.

The back support plate 33 and front support plate 34, each formed of a synthetic resin, are attached to the inner surface of the lower end portion of the header case 11. A holder plate 71 serving as a movable member is inserted to be slidable in the vertical direction between the back support plate 33 and front support plate 34. A fluorine-based rubber sheet 72 is fixed on a side surface of the holder plate 71.

This rubber sheet 72 is provided horizontally along the longitudinal direction of the folded portion 15*c*, and the lower portion of the rubber sheet is bent to form a loop portion 72*a*. The loop portion 72*a* is located to face the gap between the filler member 70 and the hall door 6*f*.

As in the case of the upper holder plate 32 in the first embodiment, the holder plate 71 is elastically urged upwards by a torsion spring serving as urging means. Then, just before the hall door 6*f* is closed, the holder plate 71 is pushed downwards against the force of the torsion spring by a cam mechanism similar to that of the case of the first embodiment.

In this embodiment, when the hall door 6*f* is opened, the holder plate 71 is elastically pushed upwards as shown in FIG. 15, thus maintaining a state in which the rubber sheet 72 is apart from the gap between the filler member 70 and the hall door 6*f*.

From this state, when the hall door 6*f* moves in such a direction to close the door and reach a position just before the door is completely closed, the holder plate 71 and the rubber sheet 72 move downwards as an integral unit as shown in FIG. 16. Consequently, the loop portion 72*a* of the rubber sheet 72 is brought into tight contact with the filler member 70 provided in the door header 15 and the upper section of the hall door 6*f* to bridge therebetween. As a result, the gap between the door header 15 and the upper section of the hall door 6*f* is shut in an airtight state.

In this manner, the flow of the air from an elevator hall to the shaft is shut off, and therefore the smoke of a fire cannot enter the shaft from the elevator hall. Thus, the sealing device of this embodiment can prevent the shaft from serving as a chimney, thereby suppressing the spreading of the fire. Further, the diffusion of the smoke to some other floor can be prevented.

Further, as in the case of the first embodiment, the sealing mechanism of this embodiment can be installed in a small space with regard to its height direction as well as its thickness direction. Therefore, the sealing mechanism can be installed in an already constructed building without requiring a large-scale reform in its renewal construction.

Further, the rubber sheet 72 of the sealing mechanism does not slide on the hall door 6*f* that is opened and closed, but it is brought into contact with the door 6*f* just before it is completely closed. With this operation, the rubber sheet 72 is not easily worn out, and stands up to long use. Further, the frictional force during sliding and the reactive force after the door 6*f* is closed can be reduced to extremely low levels. Furthermore, an actuator or wiring is not required, hence the installation and adjustment are easy.

In each of the above-described embodiments, a fluorine-based rubber sheet is used as the seal member; however the present invention is not limited to this, but a rubber material, resin material, film-like material, thin metal plate, etc. can be used as the seal member.

Further, in each of the above-described embodiments, a cam plate is provided in each movable member and a cam roller that engages with the cam plate is provided in the hanger of each door as the push down mechanism designed to push down the movable member. However, the present invention is not limited to this structure, but it is alternatively possible to take such a structure that a cam roller is provided in each movable member and a cam plate that engages with the cam roller is provided in the hanger of each door. It is further alternatively possible that an easily slidable projection is used simple in place of the movable member. Furthermore, it is possible to use a plate spring, coil spring, or the elastic property of the seal member itself instead of the torsion spring as the urging means for elastically urging the movable member upwards.

As described above, according to the present invention, there is provided a sealing device for an elevator door that is free of possibilities of wear-out of the seal member and an excessive frictional force, which requires a small installation space, easily adjustment and no wiring or a control device, and does not create an excessive reactive force or large noise of sliding when closing the door.

The sealing device of the present invention can be applied not only to a door device of an elevator, but also to door devices of a slide open/close type, which requires an airtightness.

What is claimed is:

1. A sealing device for an elevator door, comprising:

a doorway member provided for a gate of an elevator;

a door provided adjacent to the doorway member and opening or closing with respect to the doorway member;

a movable member provided horizontally in the doorway member and movably in a vertical direction and urged elastically upwards by an urging unit;

a push-down mechanism configured to push the movable member downwards against the urging unit just before the door is closed while the door is moved in a closing direction; and a sealing mechanism configured to maintain a non-contact state with respect to the door while the door is moving, and to seal a gap between the door and the doorway member when the sealing mechanism is brought into contact with both an upper portion of the door and the doorway member as the movable member is pushed down by the push-down mechanism, the sealing mechanism includes a belt seal member provided horizontally in the doorway member and made of an elastic member, a lower edge of the seal member is fixed to the doorway member; and the seal member is bent to come into contact with the upper portion of the door to seal the gap between the door and the doorway member being urged by the movable member when the movable member is pushed down by the push-down mechanism.

2. The sealing device according to claim 1, wherein:

the push-down mechanism includes a cam member provided in one of the doorway member and the door, and a pressing member provided in an other one, and the cam member and the pressing member engage with each other just before the door is closed, to push the movable member downwards.

3. The sealing device according to claim 1, wherein:

the seal member is made of one of a rubber sheet, a non-combustible rubber sheet, a film resin material and a thin metal plate.

4. A method for sealing an elevator door, the elevator door comprising:

a doorway member provided for a gate of an elevator;

a door provided adjacent to the doorway member and opening or closing with respect to the doorway member;

a movable member provided horizontally in the doorway member and movably in a vertical direction and urged elastically upwards by an urging unit;

a push-down mechanism configured to push the movable member downwards against the urging unit just before the door is closed while the door is moved in a closing direction, wherein the method comprises the steps of:

forming a sealing mechanism and maintaining the sealing mechanism in a non-contact state with respect to the door while the door is moving, the sealing mechanism includes a belt seal member provided horizontally in the doorway member and made of an elastic member;

bringing the sealing mechanism into contact with an upper portion of the door to seal a gap between the doorway member and the door when the sealing mechanism is brought into contact with both an upper portion of the door and the doorway member as the movable member is pushed down by the push-down mechanism;

fixing a lower edge of the seal member to the doorway member, wherein the seal member is bent to come into contact with the upper portion of the door to seal the gap between the door and the doorway member being urged by the movable member when the movable member is pushed down by the push-down mechanism.

5. The method according to claim 4, wherein:

the push-down mechanism includes a cam member provided in one of the doorway member and the door, and a pressing member provided in an other one of the doorway member and the door, and the cam member and the pressing member engage with each other just before the door is closed, to push the movable member downwards.

6. The method according to claim 4, wherein:

the seal member is made of one of a rubber sheet, a non-combustible rubber sheet, a film resin material and a thin metal plate.

* * * * *